US009015865B2

(12) United States Patent
Siragusa

(10) Patent No.: US 9,015,865 B2
(45) Date of Patent: Apr. 28, 2015

(54) NOTCHED COLLAR WITH SNAPS

(76) Inventor: Paul Siragusa, Mckinney, TX (US)

( * ) Notice: Subject to any disclaimer, the term of this patent is extended or adjusted under 35 U.S.C. 154(b) by 822 days.

(21) Appl. No.: 12/675,033

(22) PCT Filed: Aug. 25, 2008

(86) PCT No.: PCT/US2008/010062

§ 371 (c)(1),
(2), (4) Date: Jan. 14, 2011

(87) PCT Pub. No.: WO2009/029245

PCT Pub. Date: Mar. 5, 2009

(65) Prior Publication Data

US 2011/0099685 A1 May 5, 2011

Related U.S. Application Data

(60) Provisional application No. 60/966,144, filed on Aug. 25, 2007.

(51) Int. Cl.
*A41B 3/00* (2006.01)
*A41B 3/04* (2006.01)

(52) U.S. Cl.
CPC .... *A41B 3/04* (2013.01); *A41B 3/00* (2013.01)

(58) Field of Classification Search
USPC ..... 2/60, 98, 100, 103, 106, 116, 119, 124, 2/127, 129, 133, 135, 137, 138, 139, 140, 2/141.1, 141.2, 156, 244, 131
See application file for complete search history.

(56) References Cited

U.S. PATENT DOCUMENTS

| | | | | | |
|---|---|---|---|---|---|
| 379,032 | A | * | 3/1888 | Schloss | 2/100 |
| 978,738 | A | * | 12/1910 | Greter | 2/129 |
| 987,971 | A | * | 3/1911 | Eaton | 2/116 |
| 1,056,443 | A | * | 3/1913 | Parsons | 2/135 |
| 1,059,542 | A | * | 4/1913 | Kaiser | 2/98 |
| 1,116,488 | A | * | 11/1914 | Rodden | 2/129 |
| 1,170,972 | A | * | 2/1916 | Kafka | 2/138 |
| 1,184,188 | A | * | 5/1916 | Lipkey | 2/60 |
| 1,250,635 | A | * | 12/1917 | Osborn | 2/138 |
| 1,350,609 | A | * | 8/1920 | Hase | 2/135 |
| 1,474,896 | A | * | 11/1923 | Ekberg | 2/98 |
| 1,478,091 | A | * | 12/1923 | Woods | 2/138 |
| 1,606,920 | A | * | 11/1926 | Bornstein | 2/116 |
| 1,613,653 | A | * | 1/1927 | Goetting | 2/129 |
| 1,631,856 | A | * | 6/1927 | Dray | 2/116 |
| 1,742,816 | A | * | 1/1930 | Kennedy et al. | 2/129 |
| 1,768,384 | A | * | 6/1930 | Villasenor | 2/60 |
| 1,776,673 | A | * | 9/1930 | Tucker | 2/139 |
| 1,887,639 | A | * | 11/1932 | Hertzberg | 2/127 |
| 1,931,331 | A | * | 10/1933 | Staw | 2/95 |
| 1,980,394 | A | * | 11/1934 | Falcon | 2/98 |

(Continued)

*Primary Examiner* — Alissa L Hoey
(74) *Attorney, Agent, or Firm* — Da Vinci Partners LLC; John Moetteli

(57) ABSTRACT

A pair of notches or slits in a collar can prevent the formation of bulky crests or wrinkling when the collar is arranged in an outer open 'continental style' under a jacket, however there is also a propensity for such a collar to curl up at the notches. The invention herein discloses the use of a fastening means to prevent the slit borders, forming the edge surfaces of each back section of the collar, from curling up from the shirt surface. The fastener means are located on each side of the collar, such that one member is located on the inner surface of the back collar where the outside edge meets the base of the slit edge and the other member is located on the outer surface of the collar band.

7 Claims, 2 Drawing Sheets

(56) References Cited

U.S. PATENT DOCUMENTS

| | | | | | |
|---|---|---|---|---|---|
| 2,090,724 | A | * | 8/1937 | Drumm | 2/130 |
| 2,180,758 | A | * | 11/1939 | Honigsberg et al. | 2/116 |
| 2,182,582 | A | * | 12/1939 | Cohen | 2/60 |
| 2,199,462 | A | * | 5/1940 | Kann | 2/139 |
| 2,266,910 | A | * | 12/1941 | Rosenfeld | 2/139 |
| 2,273,742 | A | * | 2/1942 | Weinberg | 2/98 |
| 2,274,732 | A | * | 3/1942 | Paulsen | 2/139 |
| 2,318,617 | A | * | 5/1943 | Miller | 2/98 |
| 2,318,829 | A | * | 5/1943 | Zimmerman | 2/93 |
| 2,385,729 | A | * | 9/1945 | Powell | 2/116 |
| 2,405,788 | A | * | 8/1946 | Henschel | 2/139 |
| 2,451,364 | A | * | 10/1948 | Spector | 2/139 |
| 2,520,539 | A | * | 8/1950 | Goldson | 2/98 |
| 2,535,205 | A | * | 12/1950 | Harry | 2/98 |
| 2,556,039 | A | * | 6/1951 | Landert | 2/106 |
| 2,561,779 | A | * | 7/1951 | Breier | 2/98 |
| 2,569,693 | A | * | 10/1951 | Sacchitella | 2/139 |
| 2,617,106 | A | * | 11/1952 | Pritzker | 2/97 |
| 2,647,262 | A | * | 8/1953 | Crothers | 2/116 |
| 2,688,136 | A | * | 9/1954 | Freedman | 2/105 |
| 2,725,568 | A | * | 12/1955 | Honigsberg | 2/139 |
| 2,740,967 | A | * | 4/1956 | Parets | 2/139 |
| 2,834,966 | A | * | 5/1958 | Zimmerman | 2/84 |
| 2,920,328 | A | * | 1/1960 | Hammersley | 2/98 |
| 2,997,718 | A | * | 8/1961 | Jacobs | 2/139 |
| 3,127,617 | A | * | 4/1964 | Bonzi | 2/96 |
| 3,137,008 | A | * | 6/1964 | Abalman | 2/98 |
| 3,200,413 | A | * | 8/1965 | Vaughan | 2/60 |
| 3,430,264 | A | * | 3/1969 | Beukenkamp, Jr. | 2/116 |
| 3,651,519 | A | * | 3/1972 | Glick | 2/132 |
| 3,860,967 | A | * | 1/1975 | Tedesco | 2/129 |
| 4,008,494 | A | * | 2/1977 | Hicks | 2/60 |
| 4,202,054 | A | * | 5/1980 | Siragusa | 2/116 |
| 4,651,347 | A | * | 3/1987 | Brown | 2/60 |
| 4,937,884 | A | * | 7/1990 | Sherman | 2/129 |
| 5,626,267 | A | * | 5/1997 | Peruski | 223/84 |
| 5,628,064 | A | * | 5/1997 | Chung | 2/70 |
| 5,708,977 | A | * | 1/1998 | Morkunas | 2/80 |
| 5,761,744 | A | * | 6/1998 | Horvat et al. | 2/129 |
| 5,771,491 | A | * | 6/1998 | Bennett et al. | 2/98 |
| 5,864,879 | A | * | 2/1999 | Bercane | 2/93 |
| 5,956,769 | A | * | 9/1999 | Stepney | 2/129 |
| 6,481,018 | B2 | * | 11/2002 | Gagnon et al. | 2/98 |
| 7,770,236 | B2 | * | 8/2010 | Gulisano | 2/98 |
| 7,941,868 | B1 | * | 5/2011 | Shaw | 2/50 |
| 8,156,573 | B2 | * | 4/2012 | Gandy | 2/84 |
| 2005/0108805 | A1 | * | 5/2005 | Shade | 2/129 |
| 2007/0033702 | A1 | * | 2/2007 | Hsu | 2/129 |
| 2009/0183293 | A1 | * | 7/2009 | Gulisano | 2/98 |

* cited by examiner

NOTCHED COLLAR WITH SNAPS

CROSS REFERENCE TO RELATED APPLICATION

This application is the U.S. National Stage of International Application PCT/US2008/010062, filed Aug. 25, 2008, which claims the benefit of priority from U.S. Provisional Patent Application, Ser. No. 60/966,144 filed Aug. 25, 2007, the disclosures of which are incorporated by reference herein in its entirety.

BACKGROUND OF THE INVENTION

1. Field of the Invention

The invention relates to an improvement in collar construction. In particular, the collar disclosed herein offers a significant improvement and advance on the collar technology disclosed in U.S. Pat. No. 4,202,054 (hereinafter, the '054 patent).

The '054 Patent disclosed a collar comprising an elongated panel having pointed portions or wings at opposite ends of the panel wherein an opposed pair of slits extended from the free marginal edge of the collar and terminated near the marginal edge of the collar secured to the neckline (connecting marginal edge). This arrangement of slits allowed each of the paired pointed wings of the collar to move freely and independently from each other and from a central inner portion of the elongated collar panel. Therefore, a shirt, comprising such a collar, that could be worn as an ordinary closed collar, such as in a dress shirt, or under a sports jacket (or other similar outer garment) with the collar open wherein the collar wings could independently lie outside on the lapels of the outer garment without disturbing the back (central inner portion) of the collar. By independently positioning the wings in relation to the back of the collar, the 'slit' invention could prevent or minimize the formation of bulky crests or wrinkling when the collar was arranged in an outer open 'continental style' under a jacket.

In the '054 patent, the slit borders, abutting the wing sections of the collar, appropriately follow the curvature of the wing. This is likely due to the weight and deep curvature of this portion of the '054 patented collar. On the other hand, the slit borders, abutting the back section of the collar, curl up from the shirt surface. In addition to aesthetic considerations, this poses a problem for the functional advantages of the collar when used in an outer open 'continental style' under a jacket.

The present invention relates to a significant improvement in the notch collar that enables the functional advantages of the collar, when used in an outer open 'continental style' under a jacket, while also maintaining the aesthetics of the presentation. The invention disclosed herein is the use of a fastening means to prevent the slit borders, forming the edge surfaces of each back section of the collar, from curling up from the shirt surface. In the best embodiment of the invention, the fastener means are located on each side of the collar, such that one member is located on the inner surface of the back collar where the outside edge meets the base of the slit edge and the other member is located on the outer surface of the collar band. Variations from this positioning are possible but, in any case, the members should be in such a position that, when affixed, they would not impede the placement of a tie around the neck between the collar band and the collar. The various embodiments of the invention include, but are not limited to, fasteners such as snaps, buttons, zippers, buttons and hook-and-loop type fasteners.

2. Description of Related Art

Fasteners for shirt collars are well known in the Art.

U.S. Utility Pat. No. 4,937,884 discloses a shirt collar slit with elastic to hold it together.

U.S. Utility Pat. No. 2,563,687 discloses a convertible collar that can be buttoned together in multiple ways.

U.S. Utility Pat. No. 5,761,744 discloses hidden snaps to hold down a collar.

U.S. Utility Pat. No. 3,940,039 discloses snaps to hold a shirt collar down.

U.S. Utility Pat. No. 2,732,557 discloses hidden clips used to hold a collar down.

U.S. Design Pat. No. D399,6389 illustrates a design for a collar with buttons and loops to secure the collar.

In all of the preceding examples of Art, none of the invention disclosures are directed to solving the particular problem of the notched collar. Although the term of the '054 patent has expired, no known inventions in the Art have provided a solution to the problem of curled up edges of the collar at the notches while still maintaining the aesthetics of the collar presentation.

SUMMARY OF THE INVENTION

The purposes and advantages of the present invention will be set forth in, and apparent from, the description that follows, as well as will be learned.

The invention discloses an improvement in a collar having a pair of notches or slits. Such notches or slits can prevent the formation of bulky crests or wrinkling in a collar which is arranged in an outer open 'continental style' under a jacket. However, there is also a propensity for such a collar to curl up at the notches. The invention disclosed herein is the use of a fastening means to prevent the notch or slit borders, forming the edge surfaces of each back section of the collar, from curling up from the shirt surface. The fastener means are located on each side of the collar, such that one member is located on the inner surface of the back collar where the outside edge meets the base of the slit edge and the other member is located on the outer surface of the collar band. Any number of fastener means are disclosed including, and not restricted to, snaps, buttons, zippers and fabric loop-and-hoop type fasteners.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Detailed reference will now be made to the most preferred embodiments of the present invention, examples of which are illustrated in the accompanying drawings.

Figure 1:
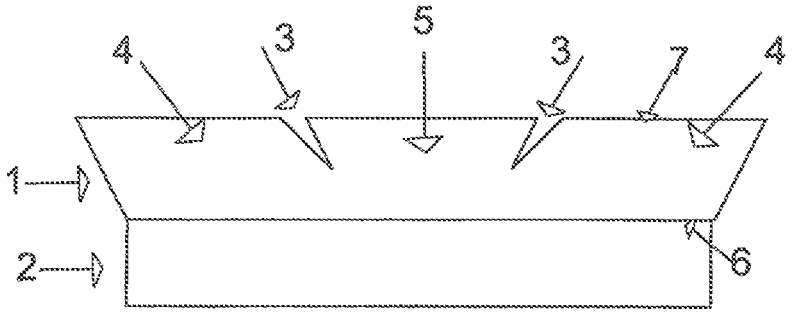
FIG. 1 illustrates a plan view of an elongated and unfolded panel showing collar and collar band when viewed from the front of a garment. The collar, in this perspective, is formed by folding at the interface (connecting marginal edge) of the collar and collar band away from the viewer's perspective.

Referring to FIG. 1, an elongated panel, flattened at the connecting marginal border 6 of the collar 1 and collar band 2, shows two notches 3 extended from the free marginal edge of the collar 7 and terminated near the connecting marginal edge 6 of the collar. This arrangement of slits allow each of the paired pointed wings 4 of the collar to move freely and independently from each other and from a central inner portion of the elongated collar panel 5.

Figure 2:
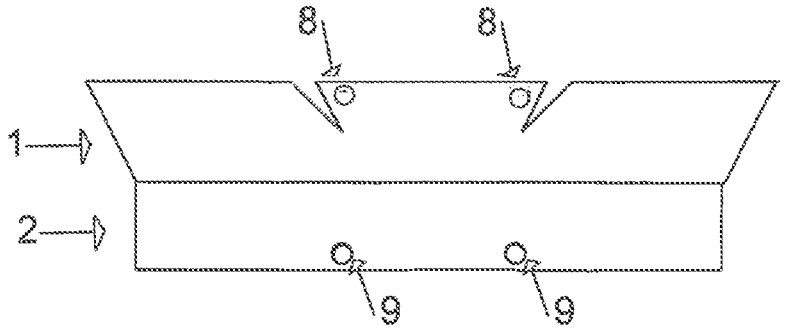
FIG. 2 illustrates a plan view of an elongated unfolded panel showing collar and collar band when viewed from the back of a garment. The collar, in this perspective, is formed by folding at the interface (connecting marginal edge) of the collar and collar band toward the viewer's perspective.

Referring to FIG. 2 and showing the same elongated panel as in FIG. 1 but from a perspective from the back of the garment, the presence and positioning of the fastener members 8,9 o the collar 1 and the collar band 2 are shown. When the collar is folded toward the viewer at the interface of the connecting marginal edge 6 of the fastener members on the collar 8 fasten to their respective members on the collar band 9.

Figure 3:
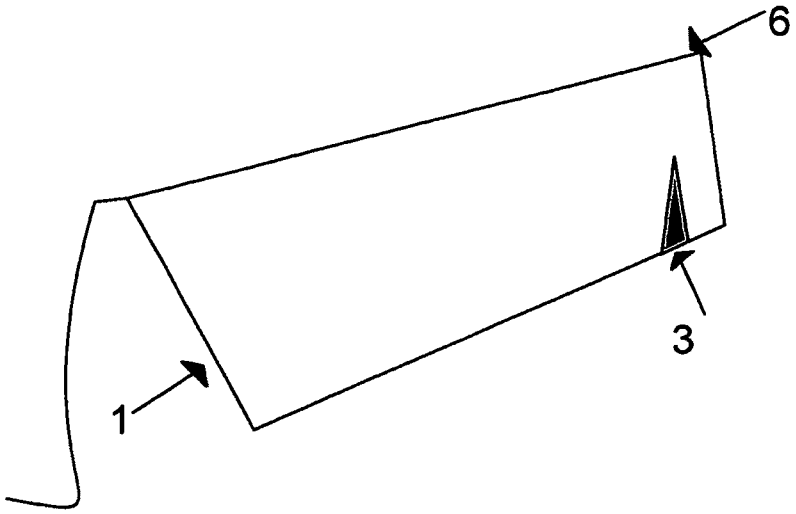
FIG. 3 illustrates a perspective view of a portion of a folded collar with fasteners secured.

FIG. 3 illustrates a perspective view of a portion of the collar 1, folded at the connecting marginal edge 6, and the notch 3 in this view fastened by the collar and collar band fastener members.

Figure 4:
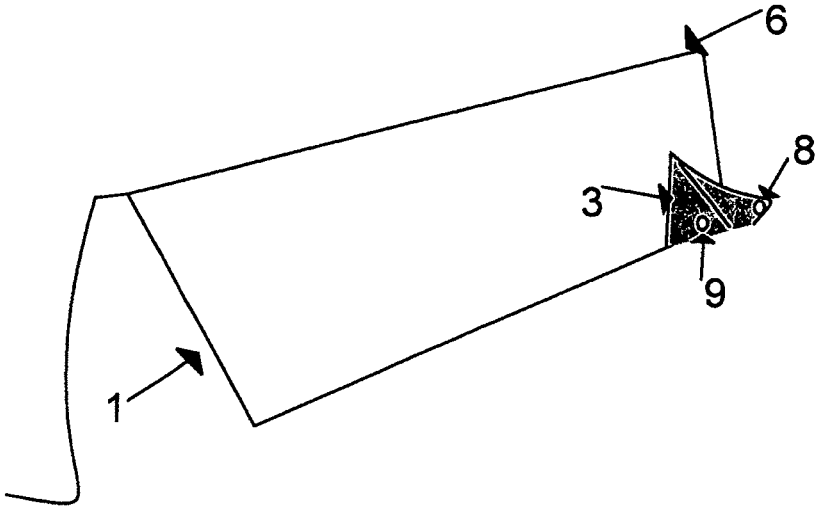
FIG. 4 illustrates a perspective view of folded collar with fasteners unsecured and one border of the slit retracted to show positioning of fasteners located on the inside of the collar and the outside of the collar band.

FIG. 4 illustrates a perspective view of a portion of the collar 1, folded at the connecting marginal edge 6. The notch 3 in this view is unfastened and the edge of the notch, which lines a portion of the central inner portion of the collar 5, is retracted to show a best mode positioning of the fastener members 8,9. The various embodiments of the invention include, but are not limited to, fasteners such as snaps, buttons, zippers, buttons and hook-and-loop type fasteners.

What is claimed is:

1. In combination, a shirt and collar, the collar comprising:

a collar band having two fastener members located on a rear portion of the collar band, the collar band having a lower edge attached to the shirt;

an elongated panel, said elongated panel having a free marginal edge and a connecting marginal edge, said connecting marginal edge attaching the collar band to the elongated panel, the elongated panel being designed to pivot along the connecting marginal edge so that the free marginal edge can be removeably secured to the collar band at a neckline of said shirt, the elongated panel having two fasteners disposed along a back portion adjacent to the free marginal edge, the elongated panel having two notches or slits formed along the free marginal edge in the back portion of the elongated panel and disposed toward an interior portion of said elongated panel, the elongated panel being divided into the back portion and two front or wing portions, said two front or wing portions having freely moving ends thereof, and wherein the two fasteners on the elongated panel are located adjacent the two notches or slits on the back portion of the elongated panel, the two fasteners face the collar band and are removeably secured to the collar band by the two fastener members; and wherein the shirt is designed to be worn under a coat or jacket.

2. The combination shirt and collar of claim 1, in which the at least two notches or slits are angled inward toward each other.

3. The combination shirt and collar of claim 2, in which the at least two notches or slits are substantially triangular in shape.

4. The combination shirt and collar of claim 1, in which the at least two notches or slits are triangular in shape.

5. The combination shirt and collar of claim 1, in which the two front or wing portions move independently of each other.

6. The combination shirt and collar of claim 1, in which the two front or wing portions further comprise, respectively a first end and a second end, the first end being at an angle with respect to the elongated collar panel other than an angle of the second end with respect to the elongated collar panel.

7. The combination shirt and collar of claim 1, in which the fastener members are selected from the group consisting of snaps, buttons, zippers, and hook-and-loop fasteners.

* * * * *